United States Patent [19]

Knutsen

[11] 4,037,423

[45] July 26, 1977

[54] PROCESS FOR PRODUCING A CONNECTING CONSTRUCTION UNIT, SUCH AS A QUAY, CONTAINER OR PLATFORM

[76] Inventor: Einar Knutsen, Astrupsvei 36, 5032 Minde, Norway

[21] Appl. No.: 610,431

[22] Filed: Sept. 4, 1975

[30] Foreign Application Priority Data

Sept. 26, 1974 Norway ..... 743469

[51] Int. Cl.[2] ..... E02B 3/20; E02D 5/20

[52] U.S. Cl. ..... 61/87; 61/48; 61/50; 114/270

[58] Field of Search ..... 61/48, 46, 46.5, 50, 61/47; 114/.5 F; 52/439, 584

[56] References Cited

U.S. PATENT DOCUMENTS

| | | | |
|---|---|---|---|
| 670,321 | 3/1901 | Judson | 61/46.5 |
| 2,233,089 | 2/1941 | Adler | 52/439 |
| 3,680,275 | 8/1972 | Romlet et al. | 61/46.5 |
| 3,717,967 | 2/1973 | Wood | 52/439 |
| 3,855,809 | 12/1974 | Westling | 61/46.5 |
| 3,894,397 | 7/1975 | Fair | 52/584 |
| 3,913,336 | 10/1975 | Figari | 61/46.5 |

*Primary Examiner*—Paul R. Gilliam
*Assistant Examiner*—Alex Grosz
*Attorney, Agent, or Firm*—McCormick, Paulding & Huber

[57] ABSTRACT

Process for producing a connecting construction unit, such as a quay, container or platform, without the use of docks. The first step involves erecting when floating on the sea a rigid raft comprised of floating elements. A construction section is formed on the raft while the latter serves as a permanent under side in the bottom part of the construction section. The construction section has downwardly extending portions comprising connecting portions between the floating elements which are produced using the elements as formwork. The elements have at least two vertical slots which intersect to form a cross or star as a result of the elements being tightened together, the slots being brought into alignment with similar slots of neighboring elements. The elements are subsequently provided or formed with the connecting portions in an upper portion of the slots.

The process can also be used for producing a submersible construction unit adapted to rest on, for example, the bottom of the sea. This process involves erecting a rigid raft having a bottom curvature corresponding to the bottom of the sea at the position of use. A construction section is then formed on the raft and the resulting construction unit is submerged by adjustable weight loading to the use position with the under side resting against the sea bottom. The construction unit has downwardly extending portions composed of rigid, deformable material. The weight loading causes deformation of certain of these portions against minor irregularities on the sea bed.

8 Claims, 6 Drawing Figures

Figure 1:
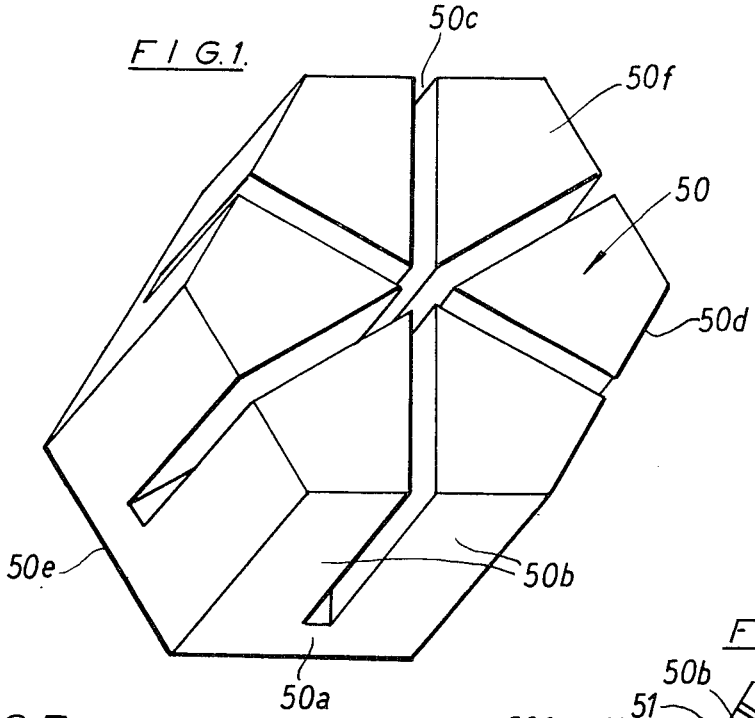

PROCESS FOR PRODUCING A CONNECTING CONSTRUCTION UNIT, SUCH AS A QUAY, CONTAINER OR PLATFORM

The invention relates, inter alia, to a process for the production of a connecting construction unit, such as a quay, container, platform or the like, without the use of docks, The process is useful for the production of a floating construction unit as well as a submersible construction unit.

When the invention is described subsequently in connection with constructions in or on the sea, it is implied that the construction can be utilised similarly in or on a lake or another body of water.

In to-day's society, there exists a need for especially large constructions in or on the sea. This invention is especially relevant to oil and gas boring activities, for example in the North Sea, and it is relevant to the production of boring platforms and other working platforms together with storage tanks and similar constructions. Further it is relevant to production of piers, quays, small boat harbours, tunnels, containers for purifying plants and the like in connection with land installations.

Hitherto, such large constructions have been produced in large dry docks in order, thereafter, to convey the construction in a floating condition and tow the construction into place at the position of use. In order to be able to produce constructions in such dry docks, suitable ground conditions are required in the dry dock. The possibility of being able to produce suitable dry docks at naturally appropriate locations along our coast is limited since there must be taken into account both the ground conditions and conditions at the edge of the shore by the dry dock. In addition, suitable access roads are required for forwarding raw materials to the dry dock.

In the use of dry docks, one must depend to a large degree upon the bottom contour of the construction not deviating substantially from the bottom contour of the dry dock where substantial deviations do exist, problems can be encountered in towing the constructions away from the dry dock when constructions are to be transported into position at the place of use.

An aim of the present invention, is to provide a process is independent ot the sea bottom at the building location so that the process can be carried out at more arbitrary locations along out coast, for example, where one can obtain most readily suitable labor and/or have suitable supply possibilities for raw materials for the construction, for example, a sand pit or a fitting-out workshop near-by. Thus the aim is a process where the production of the construction is effected without the use of docks.

In the known construction of the "Echo Fish Tank" type, for the storage of oil in the North Sea, the construction was made with a specially powerful bottom construction so as to be able to tolerate the point loading which must occur at the place of use. In addition, it is preferred to cast or mould on the under side of the construction at the use position so as to ensure that this can be disposed surely and stably on the ground. The powerful bottom construction and under side casting or moulding are especially expensive for the construction, this in spite of the fact that the bottom conditions at the position of use are relatively favourable.

With the present invention the objective is to be able to produce the construction with an arbitrarily suitable design for the bottom. For example, the aim can be in respect of a submersible construction unit to produce the construction bottom with local downwardly projecting portions which can either adapt themselves to the curvature along the sea bottom by local deformation of the bottom of the construction and/or can deform the sea bottom locally so that the best possible adaptation of the construction to the conditions at the bottom can be achieved.

With the present invention, the aim is to provide a process which can be carried out in an especially labour-saving and easy manner since the objective is to employ an especially simply constructed, light weight means for carrying out the process.

According to the present invention a process for producing a connecting construction unit, such as a quay, container, platform, without the use of docks, comprises a. initially erecting when floating on the water a rigid raft composed of floating elements with downwardly extending portions and b. forming a construction section on said raft while the latter serves as a permanent under side in the bottom part of said construction section, c. whereas said floating elements being provided with at least two vertical slots running together in the form of a cross or star as a consequence of said elements being tightened together in mutual abutment with each other, with the slots brought into alignment with corresponding slots of neighbouring elements and said elements being subsequently provided with said connecting portions therebetween in an upper portion of said slots.

According to the present invention a process for producing a submersible construction unit, such as a quay, container, platform, without the use of docks, which construction unit is adapted to rest against the bottom of a body of water in the position of use, comprises a. initially erecting on said body of water a rigid raft composed of floating elements and having a bottom curvature substantially corresponding to the curvature of the bottom of said body of water at said position of use together with downwardly extending portions formed from a relatively rigid, deformable material, b. forming a construction section on said raft while the latter serves as a permanent under side in the bottom part of said construction section, and c. submerging the resulting construction unit by adjustable weight loading to said use position with said under side resting against said bottom of said body of water, said adjustable weight loading causing deformation of certain of said downwardly extending portions gainst minor irregularities at said bottom of said body of water, and the downwardly extending portions partly constituting connecting portions between said floating elements and partly constituting portions deformable against said bottom of said body of water and being produced while employing said floating elements as formwork, said floating elements being provided with at least two vertical slots running together in the form of a cross or star as a consequence of said elements being tightened together in mutual abutment with each other, with the slots brought into alignment with corresponding slots of neighbouring elements and said elements being subsequently provided with said connecting portions therebetween in an upper portion of said slots and said deformable portions in a lower portion thereof.

According to the invention, there is achieved an especially favourable utilisation of the material of the deformable and connecting portions by allowing these to pass directly over into each other in common formwork slots. In the same connection, the production can be performed in an especially controlled and effective manner by producing the deformable and connecting portions in a more or less continuous process, from one and the same material or from their respective materials. Thus in a ready manner the deformable parts and the connecting members — even if these pass directly over into each other — can be respectively given in a ready manner totally specific properties of use, each for its purpose. If desired, there can be utilised prefabricated parts of the deformable portions.

In this connection, it is preferred that the connecting portions are made with reinforcements which pass continuously through a series of connecting floating elements, while the deformable portions are made without reinforcements or, at the most, with locally limited reinforcements. In this way, the deformable portions can be allowed from the production point of view, to be combined directly with the connecting portions, while they can be given various useful properties in a ready and easily controllable manner.

As an example, it can be mentioned that the deformable portions can be made so as to be limited locally to a region between approximately the centre of a first section to approximately the centre of an adjacent neighbouring section. This involves the avoidance of the formation of stiffening points of intersection mutually betweeen the deformable portions so that these can be deformed, in an intended manner, independently of each other, while they are rigidly connected separately on the other side, to the connecting portions which cross each other in the form of a star- or cross-shaped point of intersection at a level above the level of the deformable portions.

It is preferred to employ an annular stiffening member for centering the neighbouring elements relative to each other and it is especially advantageous to arrange such stiffening members in or just by the deformable portions. By utilising such annular stiffening members, the floating elements can be coupled together in pairs in a ready manner or in groups of, for example, three elements and, at the same time, centering of such elements can be achieved relative to each other. During use in the finally moulded-in condition, such stiffening members can be given a local stiffening by the bottom construction in the transition between the deformable portions and the connecting portions.

The invention also includes an element to form part of a formwork for producing a floating construction. Said element consists of a block of floatable material, said block is provided with vertical side faces arranged to abut corresponding side faces of sidewise abutting blocks and allowing relative movement of said block in parallel with said side faces thereof, and horizontal top faces arranged to form first formwork faces for producing thereon a bottom part of said floating construction, and internal slots opening between said top faces to form second formwork faces for producing therein projections integrally with the bottom part of the floating construction and opening in said side faces to form said second formwork faces in alignment with corresponding formwork faces of abutting blocks.

By utilising element which essentially consist mainly of floating material, optimum floating properties can be achieved for the raft formed and especially light-weight elements which are easy to manipulate into place in a desired position in the raft to be produced. Thus, it is possible to bend the elements tightly together against each other with the vertical slots of the elements brought into alignment with corresponding slots of the neighbouring elements by means of simple centering means such as an annular stiffening member. There can be produced, therefore, very readily but at the same time accurately centered also, formwork having effectively sealed junction joints between the elements, obtained by direct abutment of element surface to element surface.

It is preferred that the vertical slots at the top pass straight through the element, while at least certain of the slots below are limited locally in the lateral direction, so that underneath mutually crossing slots are avoided, and/or connections between the lower slot portions of adjacent elements are prevented.

A significant advantage of such a solution is that the upwardly projecting side portions of the element can be connected to each other locally underneath, to form desired points of intersection between side portions of the element so as to strengthen thereby the formwork in the first phase of the moulding process. This advantage comes in addition to the advantage which is obtained during the use of the outwardly moulded construction by preventing the outwardly moulded deformable parts forming points of intersection in the floating element.

Figure 2:
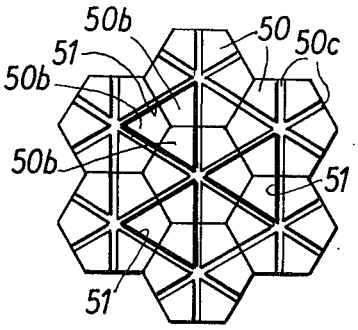
Figure 3:
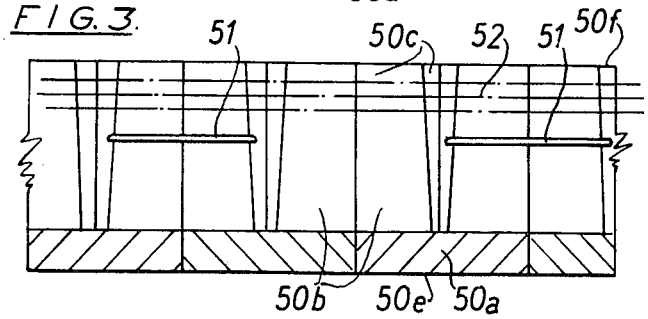
Figure 4:
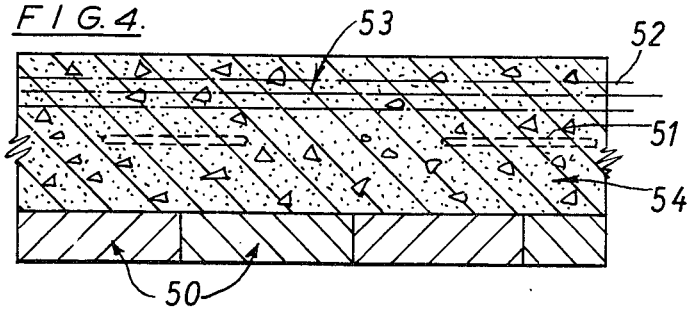
Figure 5:
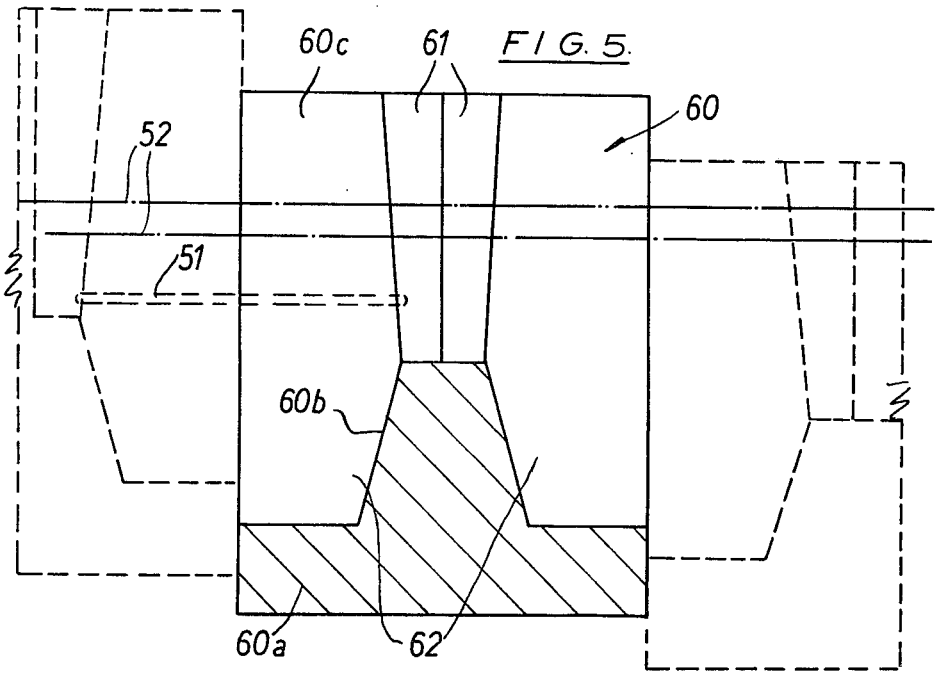
Figure 6:
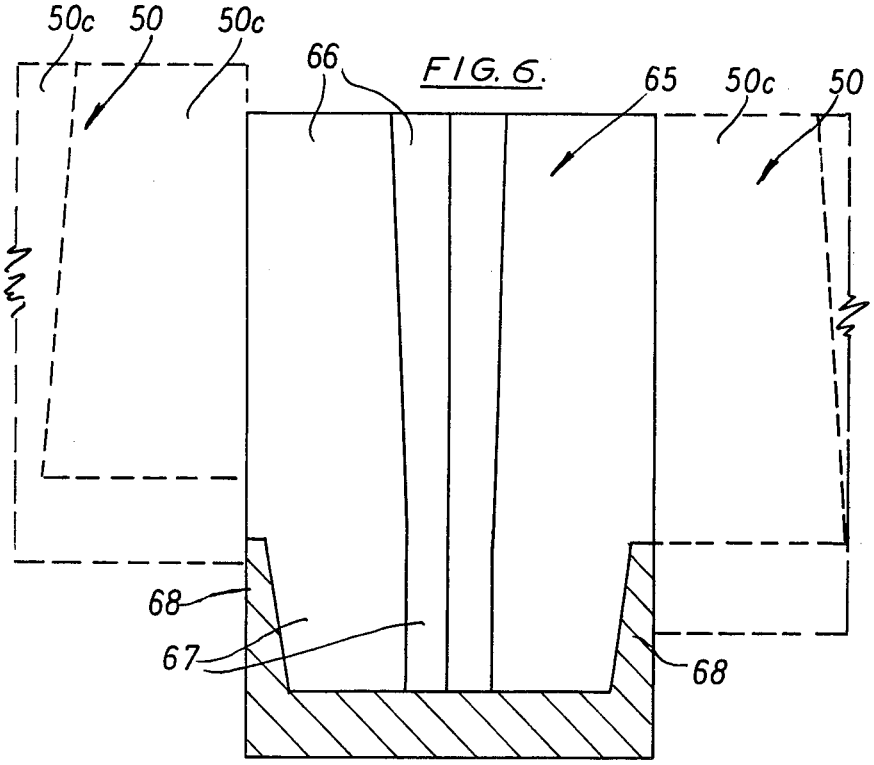

In order that the invention can be more clearly understood, convenient embodiments thereof will now be described, by way of example, with reference to the accompanying drawings in which:

FIG. 1 is a perspective view of a floating element according to the invention, FIG. 2 is a plan of a number of floating elements arranged together to form a portion of a raft, FIG. 3 is a cut-off vertical section of the floating elements of FIG. 2, FIG. 4 is a similar vertical section to that of FIG. 3 after filling of the formwork-forming raft with moulded material, FIG. 5 is a similar vertical section of an alternative embodiment, FIG. 6 is a similar vertical section of a further embodiment, Referring to FIG. 1, a floating element 50 is made entirely of floating material and is produced in a coherent piece. The element has a disc-shaped bottom portion 50*a* from which project upwardly, mutually separate vertical portions 50*b* which between them define vertical slots 50*c* opening upwardly and laterally outwards. Element 50 can be seen to have a regular hexagonal periphery with vertical outer side walls 50*d*, a flat horizontal bottom side 50*e* and mutually aligned, horizontal top sides 50*f*.

In FIG. 2, there is shown a section of a raft comprising seven elements which are connected to each other by means of three stiffening rings 51. The rings go over three vertical portions 50*b* on a respective one of three adjacent neighbouring elements. By means of the stiffening rings 51, there is obtained a ready centering of the elements relative to each other with mutually aligned vertical slots 50*c* and with an effective supporting abutment between the elements at their disc-shaped bottom portion 50*a* and along the vertical outer side walls 50*d*. The stiffening rings are preferably received with a narrow fit in each of the associated vertical slots. In order to obtain a desired stressing effect between the elements 50, the walls of the slots extend slightly upwardly diverging.

The stiffening rings 51 are mainly used for mounting the elements in connection with each other. After mounting, however, the elements can be bent further together with each other by means of tension means 52 received in the aligned slots 50*c* (see FIG. 3). It will be evident from FIG. 3 that the stiffening rings 51 are arranged in a central region of the slots 50*c* while the tension means 52 are arranged in an upper region of the slots, the lower region of the slots being without such stiffening rings and tension means. In FIG. 4, there is shown the filling up of the slots with sea-proof moulding material such as concrete, whereby beams are formed in the slots. It is evident that the stiffening rings 51 in the outwardly moulded material forms the transition portion between a reinforced upper connecting portion 53 and a non-reinforced lower, deformable portion 54. The tension means 52 can be employed for producing tensioned or prestressed concrete in the connecting portions.

In the illustrated embodiment, there is utilised the same moulding material in the connecting portions as in the deformable portions. The outward moulding in the vertical slots 50*c* can, consequently, be effected more or less continuously and without sharp divisions between the connecting portions and the deformable portions, if this is desirable. In an alternative embodiment, there can be utilised separately produced deformable portions which are arranged in position in associated vertical slots and which, thereafter, can be moulded together into a coherent unit with the associated connecting portions 53. In this way, the deformable portions can be produced in a controlled manner so that they are deformed, as later intended, during use thereof. A building construction (not shown) is erected upon the bottom part thus produced consisting of the raft of floating elements 50 and associated connecting portions 53 and deformable portions 54. By means of the weight of the building construction per se and further extra weight loading of filling material which can be introduced temporarily into the construction, the bottom part of the construction can be loaded so that the deformable portions are deformed against upwardly projecting irregularities in a sea or lake bed.

In an alternative construction which is illustrated in FIG. 5, an element 60 is provided with a disc-shaped bottom portion 60*a* having a central upwardly projecting stem portion 60*b* which connects with each other vertical portions 60*c* underneath. The stem portion is terminated a suitable distance below top surfaces 60*d* of the element so that the vertical portions project freely upwards and are separated from each other over the stem portion 60*b*. In this way, there are formed upper slot portions 61 which extend together in the form of a cross or star over the stem portion 60*b* and lower slot portions 62 which extend inwards to the stem portion 60*b* without connection with neighbouring slot portions 62. In a corresponding manner as illustrated in FIGS. 3 and 4, stiffening rings 51 and tension means 52 can be received in the upper slot portions, these rings and means being able to constitute, similarly as described above, reinforcements in the connecting members, while the defined deformable portions which are formed in the lower slot portions 62 are similarly without reinforcements. By means of the stem portion 60*b*, the formation of mutually stiffening points of intersection between the deformable portions can be prevented so that the latter can be deformed independently of each other.

In FIG. 6, there is illustrated an alternative design for an element 65 where, in view of the irregularities in the bed of the sea or lake where the floating element is to be arranged, it is desired to form a projection which projects locally downwards below the level of the bottom sides of the neighbouring elements. The element 65 is provided, in a manner similar to that for element 50, with slots 66 which are aligned with the slots 50*c* in the neighbouring elements 50. The bottom portion of the element 65 is provided with slots 67 which form vertical extensions of the slots 66, but which are limited endways by upwardly projecting outer wall portions 68 of the element 65. The slots 66 are, in the illustrated embodiment, extended inwards to a common central portion so that there is formed a desired point of intersection in the deformable portions which are formed in the slots 66. As a consequence of the point of intersection formed, extra resistance against deformation can be achieved and, if necessary, such a resistance can be increased by inserting local reinforcement at the point of intersection or in the adjacent portions of the deformable portions. Correspondingly, the resistance against deformation can be diminished by inserting local means which can promote a desired splitting-up of the point of intersection or, if necessary, adjacent portions of the deformable portions. There is thus the possibility of readily regulating the breaking strength of the deformable portions.

What I claim is:

1. A process for making a connecting construction unit on a body of water without the use of docks and comprising the steps of a. providing a plurality of floatable construction elements, each element having at least two intersecting slots therein, said slots extending cross-wise of said element and intersecting opposite side surfaces of said element, said slots opening through the top surface of said element and extending vertically in a major part of the height extension of said element, b. assembling the floatable construction elements in abutting relation with slots in adjacent elements in lateral communication to form a continuous network of intersecting slots and including positioning reinforcing means in said slots to form a reinforced semi-rigid raft construction, c. filling said network of slots with water-proof molding material while said raft construction is floating on the water and imbedding said reinforcing means therein to form a substantially rigid raft construction having a network of reinforced skirt-formed walls, d. and forming a connecting construction on the reinforced rigid raft construction.

2. The process as set forth in claim 1 wherein the step of assembling the floatable construction elements is further characterized as positioning said reinforcing means in only the upper portions of said slots.

3. The process as set forth in claim 1 wherein the step of positioning reinforcing means is further characterized as positioning tensioning means.

4. The process as set forth in claim 1 including the additional step of floating the construction elements on the water and wherein the step of assembling the elements is performed while the elements are floating on the water.

5. The process as set forth in claim 1 including the additional step of limiting the horizontal extent of each slot comprising said network of slots to a region extending laterally from a central portion of one element to a central portion of an adjacent element.

6. The process as set forth in claim 1 wherein the construction elements have upwardly extending vertical portions partially defining said slots and the step of assembling the elements is further characterized as positioning a stiffening member in surrounding relation with vertical portions of adjacent elements to connect the adjacent elements in aligned relation with each other.

7. The process as set forth in claim 6 wherein the step of positioning a stiffening member is further characterized as positioning a stiffening member in surrounding relation with the vertical portions and in a vertically central region of the portions of the slots defined by the vertical portions.

8. The process as set forth in claim 1 and including the additional step of adjusting the weight loading on the resulting construction unit to submerge it to a position wherein it rests on the bottom of the body of water at the position of use.

* * * * *